US008485753B2

(12) United States Patent
Manikkam et al.

(10) Patent No.: US 8,485,753 B2
(45) Date of Patent: Jul. 16, 2013

(54) SELF-CLEANING DELINEATOR

(75) Inventors: Sundar R. Manikkam, Bangalore (IN); Blessen K. Philip, Bangalore (IN)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/519,941

(22) PCT Filed: Dec. 17, 2010

(86) PCT No.: PCT/US2010/060935
§ 371 (c)(1),
(2), (4) Date: Jun. 29, 2012

(87) PCT Pub. No.: WO2011/081983
PCT Pub. Date: Jul. 7, 2011

(65) Prior Publication Data

US 2012/0275857 A1 Nov. 1, 2012

Related U.S. Application Data

(60) Provisional application No. 61/291,838, filed on Dec. 31, 2009.

(51) Int. Cl.
*E01F 9/011* (2006.01)

(52) U.S. Cl.
USPC ..... 404/9; 116/63 R

(58) Field of Classification Search
CPC ..... E01F 9/06
USPC ..... 404/6, 9–16; 116/63 R
See application file for complete search history.

(56) References Cited

U.S. PATENT DOCUMENTS

| | | | | |
|---|---|---|---|---|
| 4,080,085 | A | 3/1978 | Dickson | |
| 4,200,904 | A * | 4/1980 | Doan | 362/183 |
| 4,323,320 | A * | 4/1982 | Liebrich et al. | 404/10 |
| 4,747,664 | A * | 5/1988 | Slaughter | 359/525 |
| 5,137,416 | A * | 8/1992 | Mohrman | 415/2.1 |

(Continued)

FOREIGN PATENT DOCUMENTS

| | | |
|---|---|---|
| DE | 2108928 | 9/1972 |
| FR | 2704571 | 11/1994 |

(Continued)

OTHER PUBLICATIONS

International Search Report for PCT/US2010/060935, Mailing Date Aug. 2, 2011, 4 pages.

*Primary Examiner* — Raymond W Addie

(57) ABSTRACT

Various self-cleaning delineator embodiments incorporate a delineator design that includes a shell portion, a core disposed inside the shell portion, and a reflective sheet coupled to an outer surface of the core. A wind turbine mounted on or in the delineator energizes a mechanical energy storage device, such as a spring, in response to wind or other air movement. A drive mechanism couples to the storage device and is adapted to use energy from the storage device to provide relative rotational motion between the shell portion and the core. A cleaning material disposed on an inner surface of the shell contacts the reflective sheet such that the relative rotational motion between the shell portion and the first core causes the cleaning material to slide across the reflective sheet to remove debris therefrom. The drive mechanism may include an escapement mechanism to limit the rotational motion to a maximum speed.

18 Claims, 9 Drawing Sheets

U.S. PATENT DOCUMENTS

| | | | | |
|---|---|---|---|---|
| 5,272,378 | A * | 12/1993 | Wither | 290/1 R |
| 6,109,754 | A * | 8/2000 | Steele | 359/522 |
| 7,427,173 | B2 * | 9/2008 | Chen | 404/71 |
| 2009/0184521 | A1 * | 7/2009 | Chong | 290/55 |
| 2010/0266337 | A1 | 10/2010 | Lapointe | |

FOREIGN PATENT DOCUMENTS

| | | |
|---|---|---|
| GB | 2113280 | 8/1983 |
| JP | 07-259029 | 10/1995 |
| JP | 10077611 | 3/1998 |
| JP | 2872928 | 1/1999 |
| JP | 11-162211 | 6/1999 |
| JP | 2000-212920 | 8/2000 |
| JP | 2007-331622 | 12/2007 |
| WO | WO 00-06831 | 2/2000 |
| WO | WO 03-004777 | 1/2003 |

* cited by examiner

SELF-CLEANING DELINEATOR

CROSS REFERENCE TO RELATED APPLICATIONS

This application is a national stage filing under 35 U.S.C. 371 of PCT/US2010/060935, filed Dec. 17, 2010, which claims priority to Provisional Application No. 61/291,838, filed Dec. 31, 2009, the disclosure of which is incorporated by reference in its/their entirety herein.

FIELD OF THE INVENTION

This invention relates generally to delineators that are used to control vehicle traffic on roadways and the like. The invention also relates to associated articles, systems, and methods.

BACKGROUND

Traffic delineators are known. Delineators are typically used on or near roadways or other paved or unpaved surfaces where automobiles, trucks, or other motorized or unmotorized vehicles travel. Often a series of delineators are arranged along a road, lane, or path so as to highlight or increase its visibility for the benefit of vehicle operators. FIG. 1 is an idealized perspective view of a roadway 110 along which delineators 112 have been placed to mark the path or direction of the roadway. Delineators can also be used in construction work zones to help guide vehicles along rerouted paths that may be unfamiliar to the vehicle operators. Perhaps because delineators can be used to direct or "channel" traffic in a given direction, they are sometimes also referred to as channelizers.

In some cases, delineators may be used in applications where visibility from only one direction is considered important. In other cases, e.g., when placed between lanes of traffic that move in opposite directions, it may be important for the delineator to exhibit high visibility from both such directions. In still other cases, such as at intersections, it may be important for the delineator to exhibit high visibility from four or more different directions, e.g., north, south, east, and west.

An example of a known delineator design is simply a post attached to a base. For improved visibility, the post may comprise high visibility materials. For daytime visibility, the post may be fabricated from bright diffuse materials, such as white or orange paint. For nighttime visibility, retroreflective sheeting may be wrapped around a portion of the post. Retroreflective sheeting has the characteristic of directing incident light back in the general direction from which it came, regardless of the angle at which the light impinges on the surface of the sheeting. Thus, as a vehicle approaches a roadway sign or other structure on which a retroreflective sheet is mounted, light from a vehicle headlamp may impinge on the sheeting, which then reflects the light back in the general direction of the headlamp. The retroreflection occurs in a small but finite angular cone, which cone encompasses the eye of the vehicle operator so that the operator perceives the sign as being conspicuously bright and highly visible.

FIGS. 2 and 3 are provided for background purposes to exemplify two angles that may have some significance when discussing retroreflective sheeting, or other reflective sheeting. FIG. 2 is a top view of a vehicle 210 traveling in a direction 212 along a roadway 214. Reflective sheeting 216 is provided near the side of the road. Sheeting 216 is assumed to be flat and planar, and the axis 218 is perpendicular to the plane of the sheeting. (In cases where the reflective sheeting is not flat, each portion of the sheeting may be considered to be flat if the size of the portion is small enough.) Axis 220 represents the direction along which light from the vehicle headlamp impinges upon the sheeting 216. The angle $\beta$ between the axes 218 and 220 is referred to as the entrance angle for the light. A side view of this situation is shown in FIG. 3, where the vehicle headlamp (or other light source) is shown separately and labeled as 310, and the eye of the vehicle operator (or other observer) is shown separately and labeled 312. An axis 314 extends directed between the headlamp 310 and the sheeting 216. Another axis 316 extends between the sheeting 216 and the observer 312. The angle $\alpha$ between the axes 314, 316 is referred to as the observation angle.

In some cases, delineators may be subject to a significant amount of dust, dirt, mud, soot, grime, fumes, and/or other debris that may accumulate on the reflective sheet to an unacceptable level that makes the delineator difficult to see. A number of approaches have been proposed by others to maintain the visibility of the delineator in such circumstances, but each of these approaches has distinct drawbacks.

BRIEF SUMMARY

We have developed various types of self-cleaning delineators. At least some of them generally include a shell portion, a core disposed inside the shell portion, and a reflective sheet coupled to an outer surface of the core. A wind turbine is mounted on or in the delineator, and energizes a mechanical energy storage device, such as a spring, in response to wind or other air movement. A drive mechanism couples to the storage device and is adapted to use energy from the storage device to provide relative rotational motion between the shell portion and the core. A cleaning material disposed on an inner surface of the shell, or the inner surface of the shell itself, contacts the reflective sheet such that the relative rotational motion between the shell portion and the first core causes the cleaning material to slide across the reflective sheet to remove debris therefrom. In this way, the delineator maintains a high visibility by keeping the reflective sheet relatively clean and debris-free. The drive mechanism may include an escapement mechanism to limit the rotational motion to a maximum speed.

In some cases, the escapement mechanism can limit a rate at which energy can be taken from the storage device to a maximum rate. This maximum rate may be substantially smaller than a rate at which the wind turbine can deliver energy to the storage device.

In some cases, the escapement mechanism limits the relative rotational motion to a maximum rotational speed. The maximum rotational speed may be, for example, 1 revolution per hour or less.

In some cases, the drive mechanism is adapted to rotate the shell portion while the core remains stationary. In such cases, the window region may extend around substantially an entire circumference of the shell portion such that at least a portion of the reflective sheet is visible from a given azimuthal angle for all rotational positions of the shell portion.

In some cases, the drive mechanism is adapted to rotate the core while the shell portion remains stationary. The reflective sheet may be bonded to the outer surface of the core, and may extend around substantially an entire circumference of the core.

In some cases, the reflective sheet is in the form of a band, a first portion of which is held in tension against the outer surface of the core. The first portion of the reflective sheet may contact the outer surface of the core, while a second portion of the reflective sheet does not contact the outer surface of the core.

In some cases, the delineator may further comprise a second core disposed inside the shell, and the reflective sheeting, which may be the band-shaped, may be held in tension between the first-mentioned core and the second core.

In some cases, the delineator may comprise a cleaning material disposed on the inner surface of the shell portion and contacting the reflective sheet in such a way that the relative rotational motion between the shell portion and the first core causes the cleaning material to slide across the reflective sheet to remove debris therefrom.

In some cases, the window region comprises one or more apertures formed in the shell portion. In some cases, the delineator may include a planetary gear mechanism that couples the wind turbine to the mechanical energy storage device.

Related methods, systems, and articles are also discussed.

These and other aspects of the present application will be apparent from the detailed description below. In no event, however, should the above summaries be construed as limitations on the claimed subject matter, which subject matter is defined solely by the attached claims, as may be amended during prosecution.

BRIEF DESCRIPTION OF DRAWINGS

In the figures, like reference numerals designate like elements.

DETAILED DESCRIPTION OF ILLUSTRATIVE EMBODIMENTS

Figure 1:
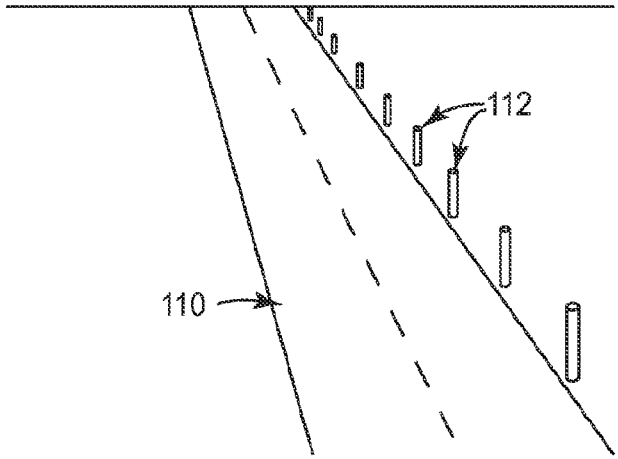
FIG. 1 is a perspective view of a roadway with delineators positioned along the roadway.

In FIG. 4, a self-cleaning delineator 410 is shown in schematic elevational view. The delineator includes a delineator body portion 412, a base 414, a shell portion 416, and a core 418 (not visible in FIG. 4*a* but shown in later figures). For reference purposes, a Cartesian x-y-z coordinate system is also included in the figure. The z-axis of the coordinate system is parallel to a longitudinal axis of the delineator.

The body portion 412 is in the form of a tube having a lower end 412*a* that is adapted to fit tightly within an opening of the base 414 as shown. The base, which can be of any known design, has a sufficient weight and/or is provided with sufficient attachment mechanism(s) to the pavement or ground so as to keep the delineator in an upright position after installation. In some cases, the base may be integrally formed with the outer shell, while in other cases the base may be press-fit, adhered, or otherwise permanently, semi-permanently, or releasably attached to the shell 414. If the delineator is not omnidirectional, i.e., if it is designed to have one or more preferred viewing orientation, then the base 416 may be provided with a distinctive shape, marking, or other alignment feature that indicates to an installer how to properly orient the delineator relative to the direction of traffic or another characteristic of the surroundings.

On the upper end of the body portion 412, the shell portion 416, a reflective sheet, and other components are mounted that are capable of keeping the reflective sheet relatively clean so as to maintain the high visibility of the delineator, as will be described further below. The body portion 412 is shown to be tapered or narrowed in a central portion thereof between its upper and lower ends, but the taper may be omitted in alternative embodiments.

Atop the body portion 412 is mounted the shell portion 416, the core 418, and a wind turbine 424. A reflective sheet 422 is coupled to an outer surface of the core 418. In the case of delineator 410, the sheet 422 is actually wrapped around substantially the entire circumference of the core 418, and is firmly bonded, e.g. with an adhesive, to the core's outer surface. Portions of the reflective sheet are visible through apertures in the shell portion 416, the apertures forming a window region 420 in the shell portion. The various apertures are identified by labels 420*a*, 420*b*, 420*c*, 420*d*, 420*e*, 420*f*, 420*g*, 420*h* in the figures, although other window region designs, and other aperture patterns, can also be used.

The core/shell design of delineator 410 allows for relative rotational motion between the core and the shell. This rotational motion forms the basis of the cleaning action for this delineator. Cleaning may be facilitated by a cleaning material, as described further below, disposed on an inner surface of the shell portion. The shell portion and the outer core are sized so that the cleaning material sufficiently contacts the reflective sheet. The contact force or pressure between the cleaning material and the reflective sheet is not so high as to substantially interfere with the relative rotational motion, but is high enough so that when the relative rotational motion occurs, the cleaning material slides across the reflective sheet with a force or pressure that is sufficient to remove debris that may have accumulated on the surface. In some cases, depending on characteristics of the reflective sheet and characteristics of the shell portion, a separate cleaning material may not be required. In such cases, the inner surface of the shell portion may itself contact the reflective sheet and provide the sliding or scraping action needed to remove debris from the sheet.

The relative rotational motion is provided indirectly by the wind turbine 424. Thus, air movement due to naturally occurring winds, or to the motion of nearby vehicles, is intercepted by the wind turbine 424, causing it to rotate or spin. Rather than transferring this rotational motion directly to the core 418 or shell portion 416, the delineator 410 is designed to transfer this motion to an intermediate device: a mechanical energy storage device, shown schematically at box 442. The storage device 442 may be disposed or located at any convenient place in the delineator. The heart, or principal energy storage element, of the device 442 may be a spring of suitable design. As the wind turns the wind turbine 424, the rotational energy of the turbine 424 transfers energy to the storage device 442 by compressing the spring, for example. This stored energy is then converted, using a drive mechanism shown schematically at 440, to rotational motion of the core 418 or shell portion 416. The mechanical energy storage device and the drive mechanism are discussed further below.

The delineator 410 may be designed such that the shell portion 416 rotates and the core 418 (and the attached reflective sheet) remains stationary—this is referred to as a "moving shell" design. Alternatively, the delineator 410 may be designed such that the core 418 and the attached reflective sheet rotates and the shell portion 416 remains stationary—this is referred to as a "moving sheet" design. In yet other alternatives, referred to as "combination" designs, both the core and the shell are made to rotate, e.g. in opposite directions. In this regard, the rotation of the shell portion or of the core and sheet is referenced with respect to something stationary such as the body portion 412, the base 414, or the ground, for example. If the shell portion 416 is designed to remain stationary, it may be integrally formed with the body portion 412, i.e., the shell portion 416 and the body portion 412 may be two portions of a unitary construction. Regardless of whether the delineator is a moving shell, moving sheet, or combination type, relative rotational motion is set up between the reflective sheet and the shell portion, and this motion—in combination with the physical contact between the cleaning material and the reflective sheet—allows debris to be scraped or otherwise removed from the surface of the sheet. Since no other energy source is needed other than the wind or other air movement at the delineator, the delineator may be described as self-cleaning.

As mentioned above, the mechanical energy storage device 442 includes as a principal component one or more springs that may be used to store energy derived from the wind in a mechanical fashion. The device 442 may be mounted in or on the delineator in a convenient location, and may connect to the wind turbine 424 via a spindle shaft and planetary gear reduction arrangement, if desired, such that many turns of the turbine 424 are needed to compress the spring an appreciable amount (corresponding to an appreciable amount of stored energy). With such a gear reduction, rotational resistance of the turbine can be kept acceptably low, so that the turbine can be allowed to rotate relatively freely. The planetary gear reduction arrangement receives as input the relatively rapid rotation (when air currents are present) of the wind turbine 424, and provides as output a much slower rotation that can be used to compress a spring or a plurality of springs. The spring may be of any suitable design. For example, the spring may be comprise a coil spring, helical spring, torsion spring, cantilever spring, leaf spring, and/or other type of spring suitable for storing energy from the wind turbine.

The drive mechanism 440 connects to the storage device as an input and to a rotational member, such as the core 418 or shell portion 416, as an output. For example, the drive mechanism 440 may connect to the spring or springs in the device 442 in a way that releases energy from the spring by unwinding it. The mechanical unwinding motion is then translated into rotational motion by one or more gears or other mechanical means, which utilize movement mechanisms used in mechanical watches and clocks. Preferably, the drive mechanism draws (removes) energy from the storage device 442 at a relatively slow rate, e.g., at a rate that is smaller or substantially smaller than the rate at which the wind turbine can deliver energy to the storage device. If the energy taken away from the spring by the drive mechanism 440, for conversion into the rotational motion of the core or shell portion, is very small, then such rotation will be able to continue for long periods of time, without any energy being added to the spring (i.e., without any wind or air movement at the delineator).

If desired, the drive mechanism may incorporate an escapement mechanism, which is well known to mechanical clock and watch designers. The escapement mechanism limits the rotational speed of a gear or similar mechanical member. Thus, regardless of whether the spring in the storage device 442 is tightly wound or loosely wound, the escapement mechanism allows the drive mechanism 440 to unwind the spring at the same substantially constant rate. Such a device can be used to ensure energy is withdrawn from the storage device at a sufficiently low rate so that the rotary motion provided by the drive mechanism 440 can continue for long periods of time under conditions of no wind or other air movement. The escapement mechanism may help to limit the rate at which energy can be taken from the storage device to a maximum rate, e.g., a maximum rate that is substantially smaller than a rate at which the wind turbine can deliver energy to the storage device. Consequently, the rotation of the shell portion 416 or core 418 provided by the drive mechanism 440 is preferably very slow, for example, on the order of about 1 revolution per hour or slower, although rotation speeds greater than 1 rev/hr and less than 1 rev/hr may also be used as desired. This slow rotation is preferably maintained at a substantially constant speed as long as there is sufficient energy in the storage device 442. Note that a rotation rate of 1 rev/hr is the same rotation rate of an hour hand on an analog clock or watch, the slow, steady movement of which may be substantially similar to the rotational motion of a core or shell portion in the disclosed embodiments. The rotation provided by the drive mechanism may be in the same direction (e.g., clockwise or counter-clockwise) as the rotation of the wind turbine, or in the opposite direction.

Figure 4A:
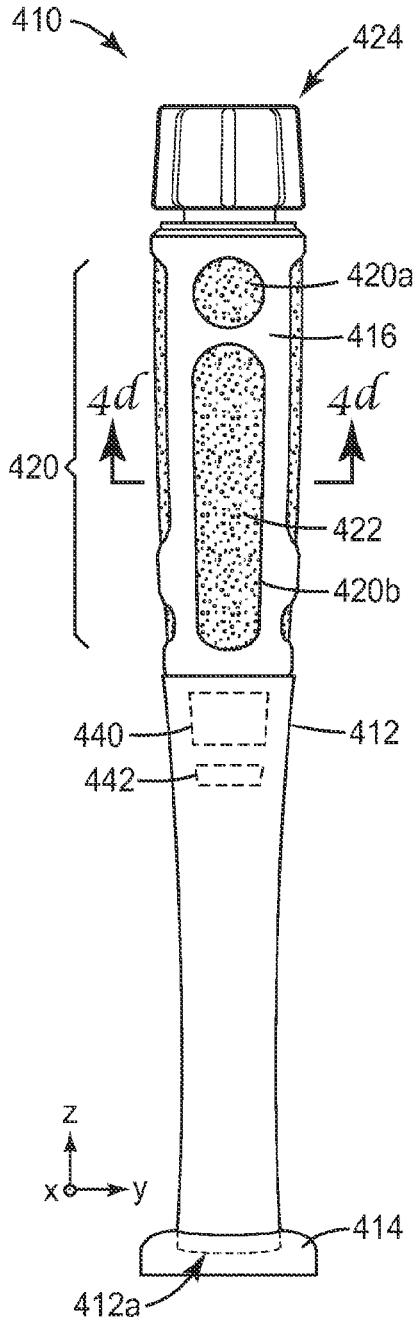
FIG. 4*a* is a schematic elevational view of a self-cleaning delineator.
Figure 4B:
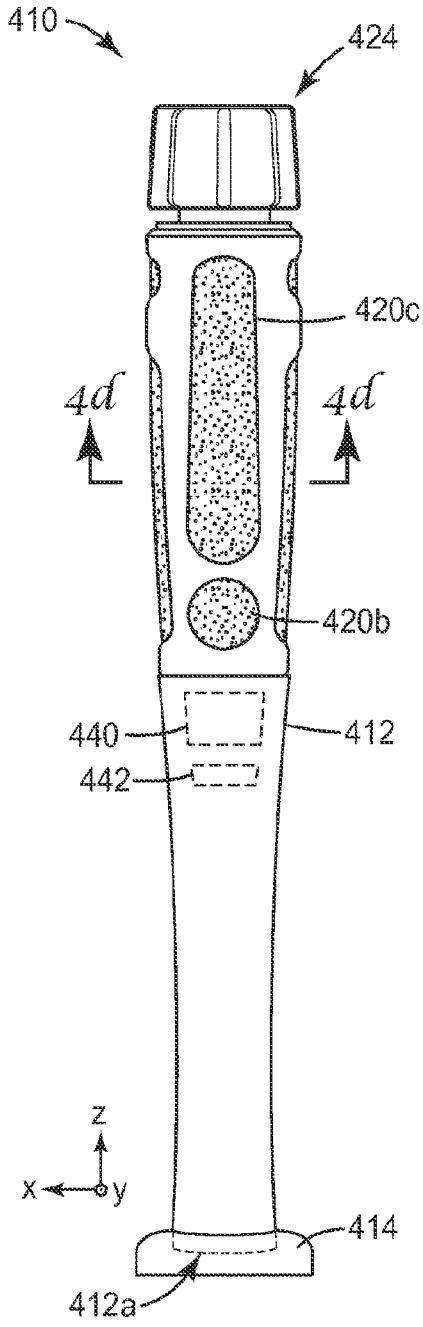
FIG. 4*b* is a schematic elevational view of the delineator of FIG. 4*a* from a different perspective.

FIG. 4*b* shows is a schematic elevational view of the delineator of FIG. 4*a* from a different perspective, namely, a perspective shifted 90 degrees in azimuthal angle. (The azimuthal angle refers to an angle measured in the horizontal or x-y plane.) From this perspective, different apertures 420*c*, 420*d* expose different portions of the reflective sheet to the viewer. The delineator 424 may thus be omnidirection, i.e., highly visible at substantially all azimuthal angles. The apertures in the window region 420 of the shell 416 may be designed so that the total area of exposed reflective sheeting is maintained above a specified threshold value for any viewing direction and for any rotation angle of the core or shell, and/or so that the retroreflectivity of the delineator is maintained above a specified level for all viewing directions and all rotation angles.

In exemplary embodiments, the delineator 410 may comprise high visibility materials and components. For example, the body portion 412 and/or shell portion 416 may be made of a brightly colored (e.g., white, orange, or other color) polymer or other suitable material, or brightly colored paints or other substances, including fluorescent materials or films, may be applied to the outer surfaces of these components for enhanced visibility. The reflective sheet 422 of FIG. 4 may provide high daytime visibility and/or high nighttime visibility. Sheeting that is retroreflective can provide high nighttime visibility. Retroreflective sheeting can be characterized by the sheeting's coefficient of retroreflectivity, which is typically measured in units of candelas per lux per square meter, or cd/(lux●m$^2$). Retroreflective sheeting may in some cases have a retroreflective coefficient of at least 10, or at least 100, or at least 500 cd/(lux●m$^2$) for head-on viewing ($\beta$=0), but the retroreflectivity may decrease or otherwise change with increasing entrance angle. The amount of decrease as a function of entrance angle depends on design details of the retroreflective sheeting.

Figure 2:
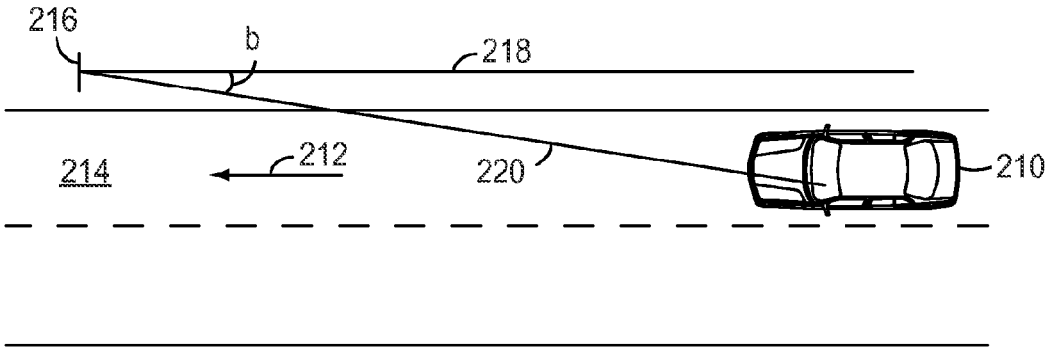
FIG. 2 is a top view of a vehicle on a roadway encountering a reflective sheet.
Figure 3:
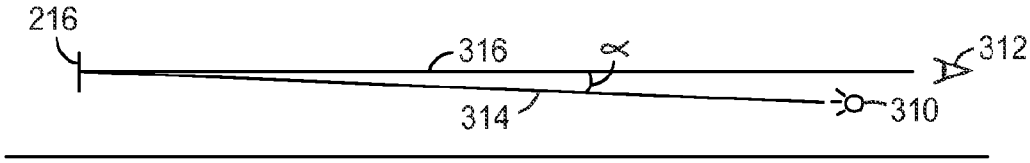
FIG. 3 is a schematic side view of selected elements of the arrangement depicted in FIG. 2.

Although retroreflective sheeting from any vendor may be used, retroreflective sheeting sold by 3M Company is preferred. Such sheeting may include 3M™ Diamond Grade™ DG$^3$ Reflective Sheeting Series 4000, 3M™ Diamond Grade™ Conspicuity Markings Series 983, or 3M™ Diamond Grade™ Flexible Prismatic School Bus Markings Series 973, for example. The Series 983 product may be considered to provide enhanced retroreflectivity at long ranges, because its retroreflectivity is particularly high at very small observation angles $\alpha$, which generally correspond to observation at large distances. The Series 4000 product, even though it also provides very good retroreflectivity at large distances, may be considered to provide enhanced retroreflectivity at shorter ranges, because its retroreflectivity decreases less than that of the series 983 sheeting as the observation angle $\alpha$ increases. Note that in addition to viewing distance, the observation angle $\alpha$ can also be affected by the vehicle size: in small vehicles, the distance from the vehicle headlamp to the vehicle operator's eye is generally smaller than for larger vehicles. Thus, at any given viewing distance, the operator of a small automobile, for example, will typically have a smaller observation angle $\alpha$ than the operator of a large truck or bus, for example. In addition to exhibiting differences as a function of observation angle $\alpha$ (FIG. 3), different retroreflective products also exhibit differences as a function of entrance angle $\beta$ (FIG. 2). Thus, for example, the retroreflectivity of the series 983 conspicuity sheeting mentioned above decreases less (for a given observation angle) than that of the series 4000 sheeting as the entrance angle increases, and can thus be said to have a wider entrance angularity.

Figure 4C:
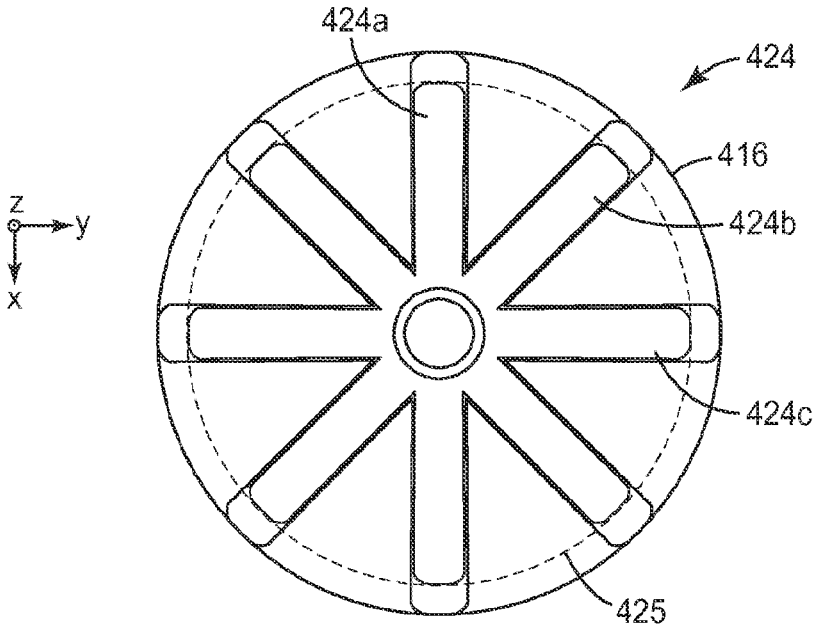
FIG. 4*c* is a schematic top view of the delineator of FIG. 4*a;*

FIG. 4*c* shows a schematic top view of the delineator 410. Here, individual vanes 424*a*, 424*b*, 424*c*, etc. of the wind turbine 424 are plainly visible. These vanes may be shaped as desired to promote efficient energy transfer from wind energy to rotational motion of the turbine. In exemplary embodiments, the vanes in top plan view do not extend beyond the periphery or border of the portion of the delineator body proximate the turbine, so that if a vehicle strikes the delineator causing it to bend and scrape against the bottom of the car frame, the vanes of the wind turbine will be protected from significant damage. The vanes may also be reduced further in size (see circular boundary 425) if a cap or cover is used to provide further protection for the wind turbine.

Figure 4D:
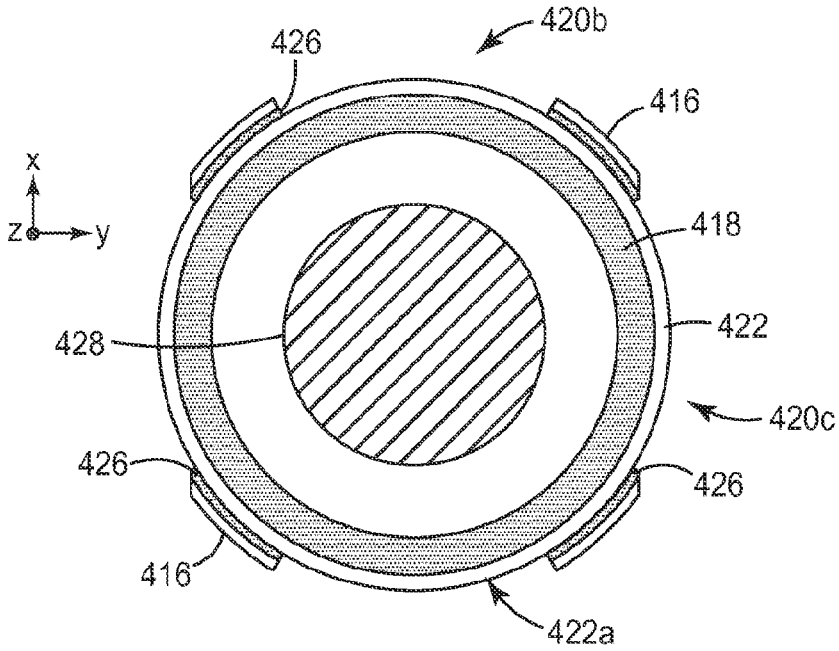
FIG. 4*d* is a schematic sectional view of the delineator of FIG. 4*a* along the lines 4*d*-4*d;*

FIG. 4*d* is a schematic sectional view of delineator 410 along the lines 4*d*-4*d* in FIGS. 4*a* and 4*b*. In this view, the core 418 can be clearly seen. The reflective sheet 422 is adhered to and wrapped around substantially the entire outer surface of the core. A seam or edge 422*a* of the sheet 422 is also shown. For some rotational positions of the core and the shell portion (such as the one shown in FIG. 4*d*), the edge 422*a* will be accessible through an aperture, but for other rotational positions the edge 422*a* will be covered or protected by the shell portion and cleaning material. The cleaning material 426 is shown adhered to the inner surface of the shell portion 416. As described above, the cleaning material contacts the reflective sheet 422 sufficiently to remove debris that may have accumulated on the surface of the sheet, but not with a force or pressure that would substantially interfere with the relative rotational motion. In an exemplary embodiment, the cleaning material may comprise a sorbent-impregnated cloth or other cloth material, or other compliant material.

Also visible in FIG. 4*d* is a rotatable shaft 428 that connects the wind turbine 424 to the mechanical energy storage device 442.

The shell portion 416 (or the portions thereof remaining between the apertures), the core 418, and the reflective sheet 422 all have substantially circular shapes in cross section so that the cleaning material 426 can maintain a good contact with the sheet throughout the full 360 degrees of azimuthal angle rotation of the core relative to the shell portion.

Figure 4E:
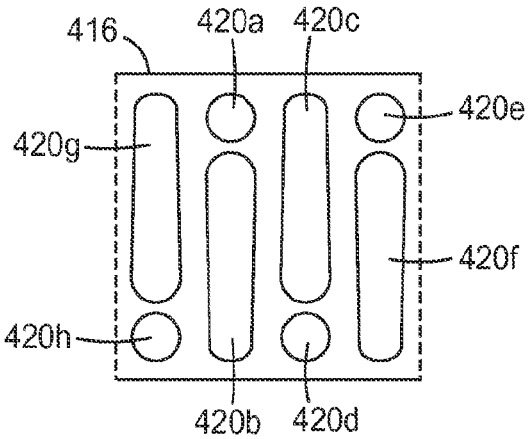
FIG. 4*e* is a schematic view of a shell portion of the delineator of FIG. 4*a* as it would look if it were cut open and laid flat.

FIG. 4*e* is a schematic view of a shell portion of the delineator of FIG. 4*a* as it would look if it were cut open and laid flat. Apertures 420*a* and 420*b*, visible in the view of FIG. 4*a*, and apertures 420*c*, 420*d*, visible in the view of FIG. 4*b*, are clearly shown. Other apertures 420*e*-*h* are also provided so that, if the delineator 410 is of the "moving shell" type, the visibility of the delineator from any given azimuthal position can be maintained above a specified threshold for any given rotation of the shell portion 416.

Figure 5:
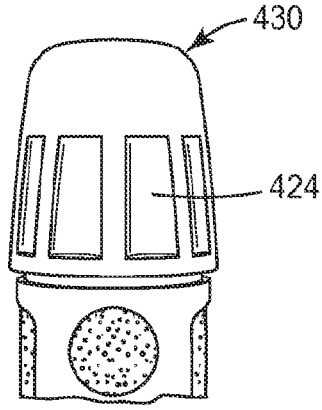
FIG. 5 is a schematic elevational view of a top portion of a delineator in which a cover member is used to protect the wind turbine.

FIG. 5 is a schematic elevational view of a top portion of a delineator such as delineator 410, but wherein a cover member 430 is used to protect the wind turbine. Preferably, the cover member is designed to balance the amount of protection provided to the wind turbine while minimizing the obstructing effect it may have on wind and air movement. As noted in connection with FIG. 4*c*, the vanes of the wind turbine may be shortened to avoid contact with the cover member so that the wind turbine is allowed to freely rotate.

Figure 6:
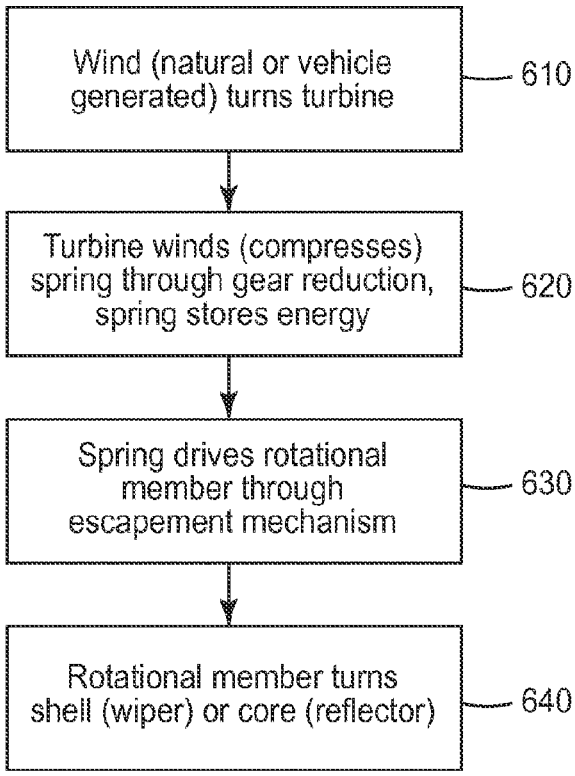
FIG. 6 is a flowchart depicting the operation of an exemplary delineator.

FIG. 6 is a flowchart depicting the operation of an exemplary delineator. In process 610, wind, whether natural or vehicle-generated, turns the wind turbine. In process 620, the wind turbine winds (compresses) the spring within the mechanical energy storage device, optionally using a planetary gear reduction mechanism. The wound or compressed spring thus stores energy from the wind mechanical fashion. In process 630, the compressed spring is then used to drive a rotational member, such as a shell portion of a delineator or a core to which a reflective sheet is applied. This action can be regulated by the use of an escapement mechanism, if desired. In process 640, the rotational member causes the shell portion or the core to turn or rotate. In some cases, the rotational member may be an intermediate component that couples to the shell portion or the core to transmit rotational motion thereto. Note that the described processes may all occur in overlapping time periods, such that, for example, energy is being transferred to the spring by the wind turbine at the same time energy is being drawn (removed) from the spring to drive the rotational member. Alternatively, the processes may occur at different times.

Figure 7:
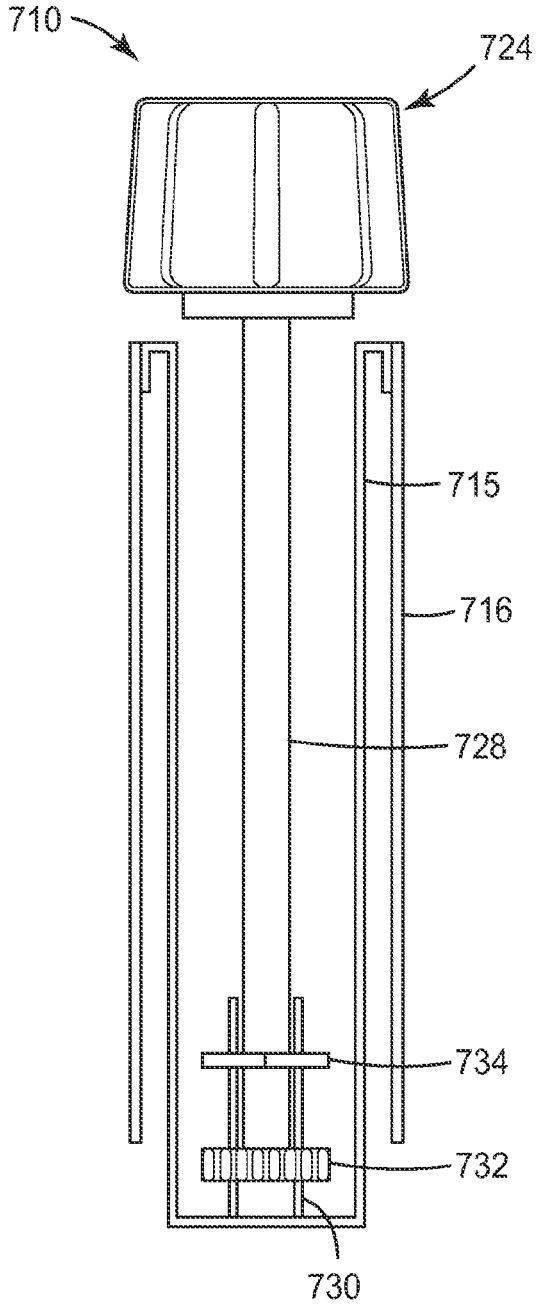
FIG. 7 is a schematic elevational view, broken-away to reveal internal components.

FIG. 7 is a schematic elevational view of a self-cleaning delineator 710, broken-away to reveal selected internal components. The delineator may have a similar or substantially the same design as delineator 410 described above, and may be of the "moving shell", "moving sheet", or "combination" design. The delineator 710 thus includes a shell portion 716, a wind turbine 724, and a rotatable shaft 728. These elements may be similar in design to shell portion 416, wind turbine 424, and rotatable shaft 428, respectively. Also shown in FIG. 7 is a cylindrical member 715 which connects at an upper portion thereof to the shell portion 716, and connects at a lower portion thereof to another rotatable shaft 730 which may be hollow and separated from shaft 728 so that the shafts 728, 730 can rotate independently of each other. The shaft 730 connects to a gear 732, which may be part of a drive mechanism, for example. A spring 734, which forms part of a mechanical energy storage device, connects to both the shaft 728 and the shaft 730. The reader will understand that only selected components of the delineator 710 are shown for simplicity.

Figure 8:
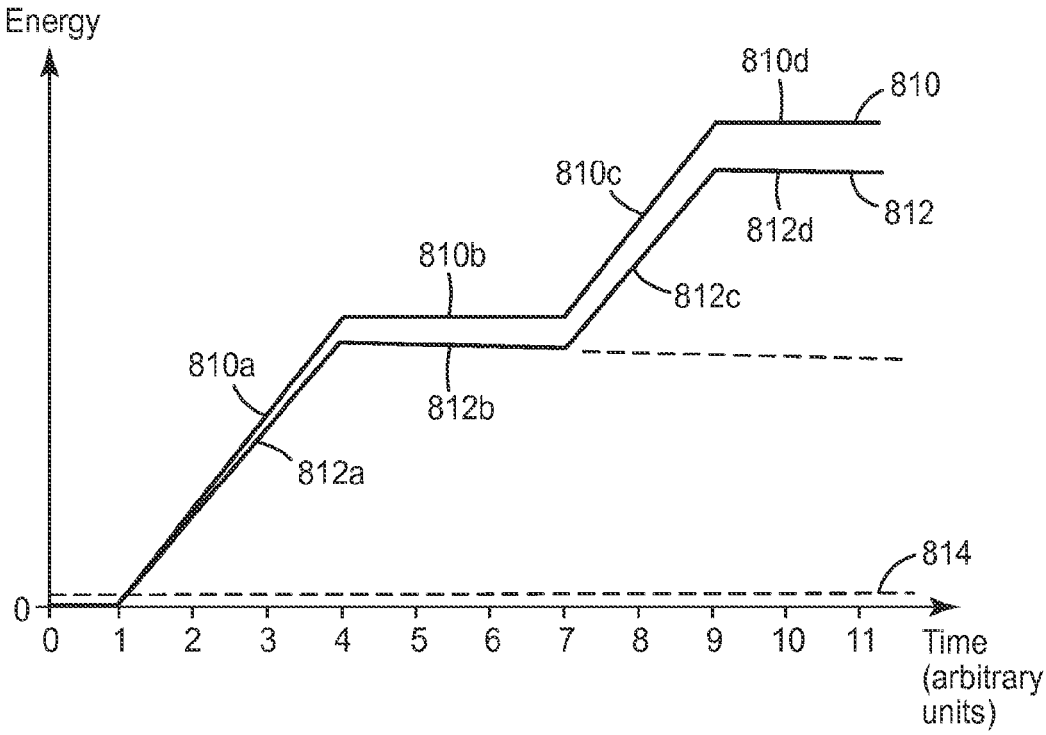
FIG. 8 is an idealized graph of energy versus time for a hypothetical self-cleaning delineator under hypothetical wind conditions.

FIG. 8 is an idealized graph of energy versus time for a hypothetical exemplary self-cleaning delineator under hypothetical wind conditions. Curve 810 represents the hypothetical energy storage profile with no energy drain, i.e., the energy that is stored in the mechanical energy storage device when the drive mechanism is disconnected, for example. Curve 810 thus represents the amount of energy stored in the mechanical energy storage device without any energy removal mechanism. Curve 812 represents the hypothetical energy storage profile with an energy drain for a rotatable drive mechanism that includes an escapement mechanism. The hypothetical energy budget for the rotatable drive mechanism with the escapement mechanism is given by the constant line 814. In this hypothetical scenario, wind or air movement is present only from time t=1 to t=4 and from t=7 to t=9 (arbitrary units of time). At other times, there is no air movement. Curve 810 thus starts at a completely uncharged state of energy=0 at time t=0. When the wind blows from time t=1 to t=4, the wind turbine spins and adds energy to the storage device as shown by segment 810*a*. When the wind stops at time t=4, the stored energy has reached a certain level, and this energy level is maintained (segment 810*b*) until the wind begins to blow again at time t=7. The blowing wind again causes the wind turbine to spin, which adds still more energy to the storage device until the wind stop again at time t=9, whereupon a higher energy level is maintained by the storage device.

When a drive mechanism, which preferably includes an escapement mechanism, is connected to the mechanical energy storage device so as to induce rotation of the shell portion or the core of the delineator, the drive mechanism removes a given amount of energy from the storage device per unit of time in order to provide the rotation. Preferably, the amount of energy drain, per unit of time, is small compared to the amount of energy that can be added over the same unit of time by the wind turbine. The small energy drain results in slightly reduced slopes of the segments 810*a-d*, which result in segments 812*a-d* respectively of curve 812. Note that if the wind did not start to blow at time t=7, segments 810*c* and 810*d* would continue in a straight line from segment 810*b*, and segments 812*c* and 812*d* would continue along the line 813. Note that the drive mechanism could continue to draw energy from the storage device for a long time, and could thus continue to rotate the core or the shell portion at a substantially constant slow rate, in the absence of air movement before it reached its baseline energy requirement at 814.

Figure 9:
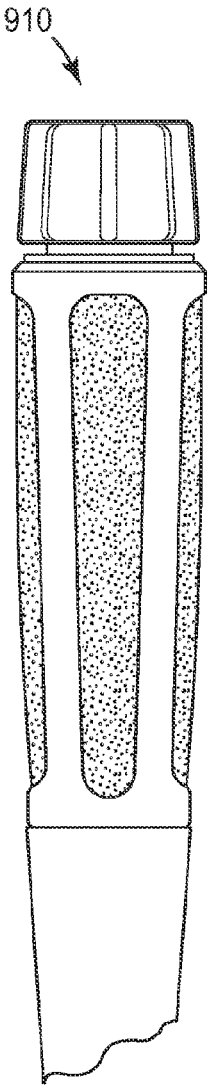
FIGS. 9-11 are partial elevational views of alternative self-cleaning delineators.
Figure 10:
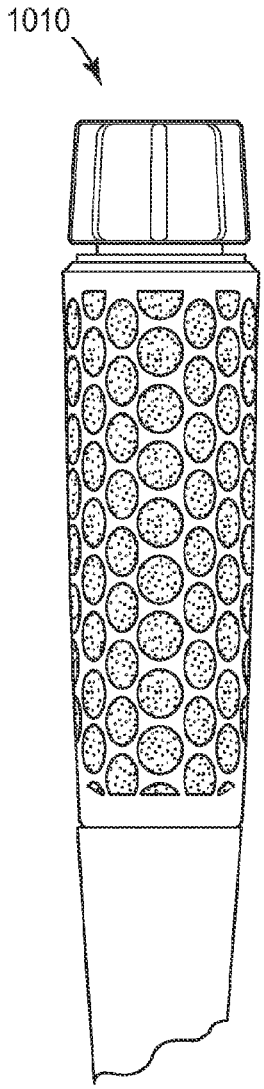
Figure 11:
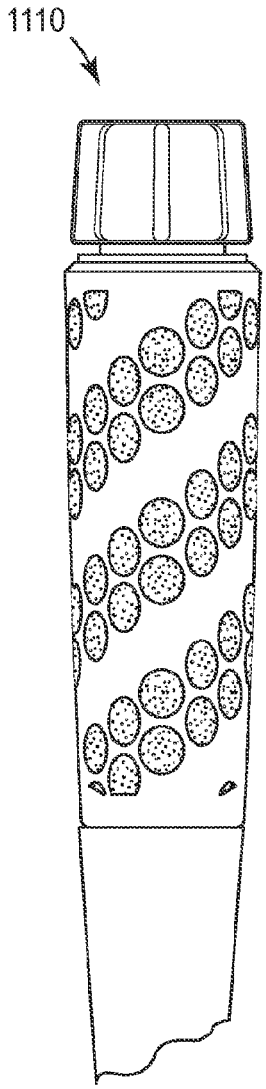

FIGS. 9-11 are partial elevational views of alternative self-cleaning delineators labeled 910, 1010, and 1110, respectively. These delineators may have a similar or substantially the same design as delineator 410 described above, and/or delineator 710 described above, and may be of the "moving shell", "moving sheet", or "combination" design. The delineators 910, 1010, 1110 demonstrate alternative aperture designs for the window region of the shell portion of the delineator. Similar to shell portion 410, a cleaning material may be adhered to interior surfaces of the shell portions of FIGS. 9-11 so that the cleaning material contacts the reflective sheet (visible portions of which are shown shaded in FIGS. 9-11) to scrape or wipe debris from the sheet over a complete 360 degree rotation of the core or shell portion. Similar to delineator 410, the delineators 910, 1010, 1110 have substantially circular cross-sectional shapes for the core, reflective sheet, and the shell portion (except for the parts of the shell portion that are missing due to the apertures).

FIGS. 12*a-d* show views of another type of self-cleaning delineator. Similar to the "moving sheet"-type delineators described above, the delineator 1210 uses a wind turbine 1224 (and optionally another wind turbine 1225) to transfer energy from the wind to a mechanical energy storage device 1242, and a drive mechanism 1240 is coupled to the storage device 1242 and to a rotatable core 1219 which is disposed or located inside a shell portion 1216, the drive mechanism preferably including an escapement mechanism to limit the rotation speed and the energy drain. The storage device 1242 may be the same or similar to storage device 442 described previously, and the drive mechanism 1240 may the same or similar to the drive mechanism 440 described previously. A reflective sheet 1222 is visible in a window region 1220 of the shell portion 1216, the reflective sheet 1222 being coupled (but in this embodiment not adhered) to the outer surface of the core 1219.

Figure 12A:
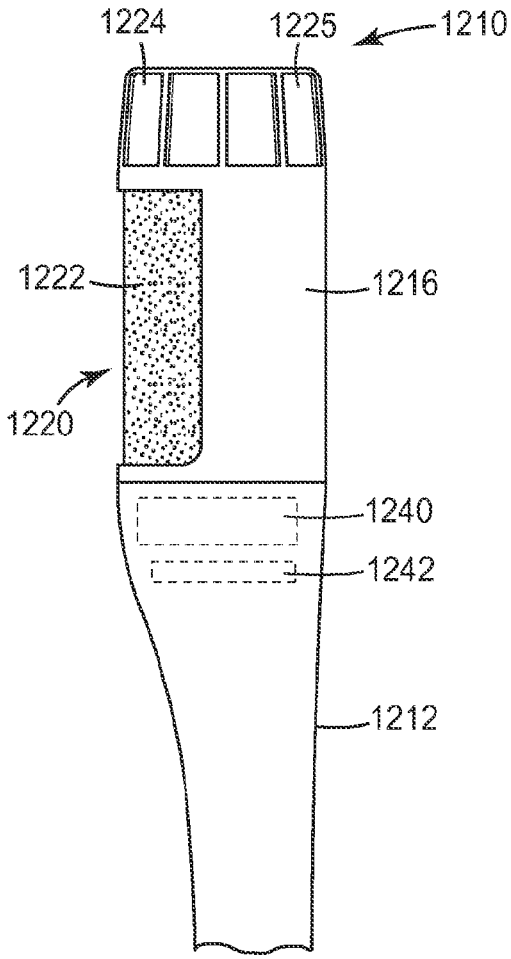
FIGS. 12*a* and 12*b* are side and front elevational views, respectively, of another self-cleaning delineator.
Figure 12B:
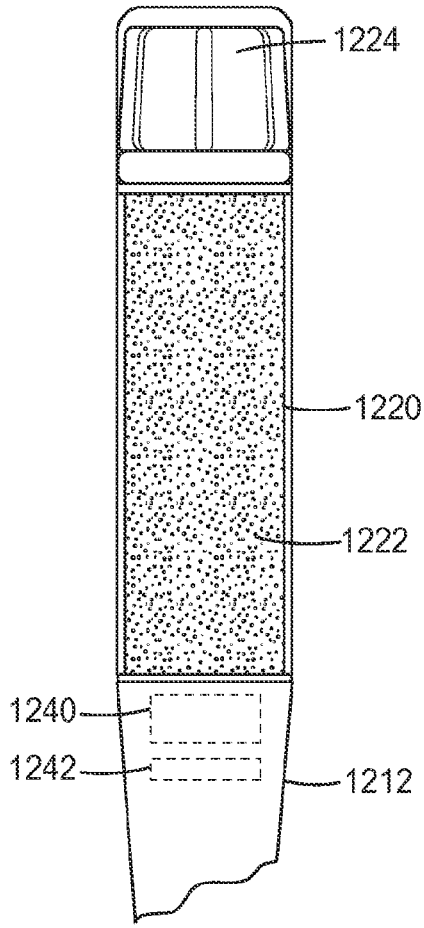
Figure 12C:
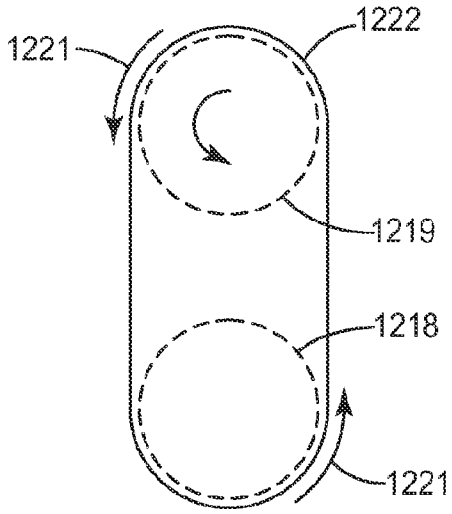
FIG. 12*c* is a schematic top view of a reflective sheet for use in the delineator of FIGS. 12*a*-12*b*.

Instead of adhering the reflective sheet to the outer surface of the core 1219, the reflective sheet is formed into the shape of a band, and is stretched or otherwise held in tension, e.g. by friction, between the core 1219 and another member, such as a second core 1218. The reflective sheet may alternatively be adhered to another material that is formed into the shape of a band, for a compound band-like construction. A schematic top or sectional view of such a band-shaped reflective sheet being held in tension between the two cores 1218, 1219 is shown in FIG. 12*c*. Preferably, the core 1219 is actively rotated or driven by the drive mechanism 1240, which may be of similar design to drive mechanism 440 described above, and the core 1218 may be free-wheeling, i.e., not actively driven, and free to rotate by the frictional forces provided by the reflective sheet. Similar frictional forces between the reflective sheet and the outer surface of core 1219 transfer the rotational motion of the core 1219 to the motion of the sheet 1222 in a cyclical path indicated by the arrows 1221 in FIG. 12*c*. Hence, the delineator 1210 may also be referred to as a "moving sheet" type delineator, but in this case at any given time one portion of the sheet is in contact with the outer surface of the core, and another portion of the sheet is not in contact with the outer surface of the core. As the sheet 1222 advances along its path, new portions of the sheet become exposed in the window region 1220, and portions of the sheet that had been exposed in the window region travel behind the shell portion 1216. Similar to the embodiments above, the interior surface of the shell portion 1216 is again preferably provided with a suitable cleaning material (not shown in FIGS. 12*a-d* but the same or similar to the cleaning material described above) that maintains physical contact with the sheet 1216 so as to scrape or wipe debris from the sheet while the sheet is disposed behind or covered by a solid portion of the shell portion 1216. In this way, the reflective sheet is again wiped clean by the cleaning material disposed on an inside surface of the shell portion. The motion associated with the cleaning motion is again provided indirectly by the wind turbines 1224, 1225, via a mechanical energy storage device, and is preferably characterized by a very slow substantially constant speed, and a small energy drain, as discussed above, although other desired motions, whether continuous or discontinuous, are also contemplated for all of the disclosed embodiments.

Figure 12D:
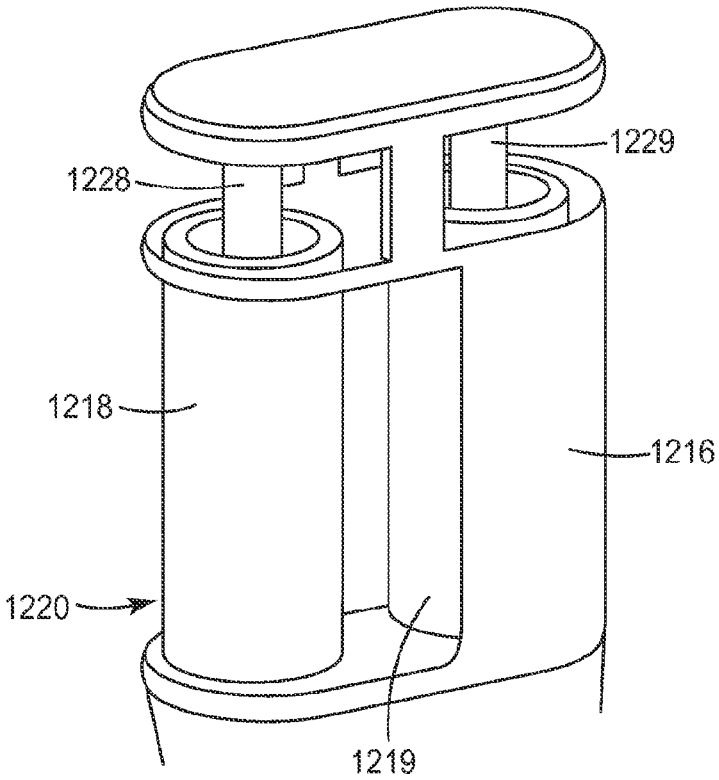
FIG. 12*d* is a schematic perspective view of portions the delineator of FIGS. 12*a*-12*b*.

In FIG. 12*d*, a shaft 1228 is shown that couples to the wind turbine 1224, and a shaft 1229 is shown that couples to the wind turbine 1225. The shaft 1229 transfers the rotational motion of the wind turbine 1225 to the mechanical energy storage device 1242. Shaft 1228 also preferably transfers the rotational motion of the wind turbine 1224 to the storage device 1242.

Unless otherwise indicated, all numbers expressing quantities, measurement of properties, and so forth used in the specification and claims are to be understood as being modified by the term "about". Accordingly, unless indicated to the contrary, the numerical parameters set forth in the specification and claims are approximations that can vary depending on the desired properties sought to be obtained by those skilled in the art utilizing the teachings of the present application. Not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, to the extent any numerical values are set forth in specific examples described herein, they are reported as precisely as reasonably possible. Any numerical value, however, may well contain errors associated with testing or measurement limitations.

Various modifications and alterations of this invention will be apparent to those skilled in the art without departing from the spirit and scope of this invention, and it should be understood that this invention is not limited to the illustrative embodiments set forth herein. For example, the reader should assume that features of one disclosed embodiment can also be applied to all other disclosed embodiments unless otherwise indicated. It should also be understood that all U.S. patents, patent application publications, and other patent and non-patent documents referred to herein are incorporated by reference, to the extent they do not contradict the foregoing disclosure.

The invention claimed is:

1. A delineator, comprising:

a shell portion having an inner surface and a window region;

a first core disposed inside the shell portion, the first core having an outer surface;

a reflective sheet coupled to the outer surface of the first core such that a portion of the reflective sheet is visible through the window region;

a mechanical energy storage device;

a wind turbine adapted to energize the storage device in response to air movement;

a drive mechanism coupled to the storage device and to the shell portion or the first core, the drive mechanism adapted to use energy from the storage device to provide relative rotational motion between the shell portion and the first core whereby the reflective sheet is cleaned of debris.

2. The delineator of claim 1, wherein the drive mechanism includes an escapement mechanism.

3. The delineator of claim 2, wherein the escapement mechanism limits a rate at which energy can be taken from the storage device to a maximum rate.

4. The delineator of claim 3, wherein the maximum rate is substantially smaller than a rate at which the wind turbine can deliver energy to the storage device.

5. The delineator of claim 2, wherein the escapement mechanism limits the relative rotational motion to a maximum rotational speed.

6. The delineator of claim 5, wherein the maximum rotational speed is 1 revolution per hour or less.

7. The delineator of claim 1, wherein the drive mechanism is adapted to rotate the shell portion while the first core remains stationary.

8. The delineator of claim 7, wherein the window region extends around substantially an entire circumference of the shell portion such that at least a portion of the reflective sheet is visible from a given azimuthal angle for all rotational positions of the shell portion.

9. The delineator of claim 1, wherein the drive mechanism is adapted to rotate the first core while the shell portion remains stationary.

10. The delineator of claim 1, wherein the reflective sheet is bonded to the outer surface of the first core.

11. The delineator of claim 1, wherein the reflective sheet extends around substantially an entire circumference of the first core.

12. The delineator of claim 1, wherein the reflective sheet is in the form of a band, a first portion of which is held in tension against the outer surface of the first core.

13. The delineator of claim 12, wherein the first portion of the reflective sheet contacts the outer surface of the first core, and a second portion of the reflective sheet does not contact the outer surface of the first core.

14. The delineator of claim 12, wherein the delineator further comprises:

a second core disposed inside the shell, the band-shaped reflective sheet being held in tension between the first and second cores.

15. The delineator of claim 1, further comprising a cleaning material disposed on the inner surface of the shell portion and contacting the reflective sheet in such a way that the relative rotational motion between the shell portion and the first core causes the cleaning material to slide across the reflective sheet to remove debris therefrom.

16. The delineator of claim 1, wherein the window region comprises one or more apertures formed in the shell portion.

17. The delineator of claim 1, further comprising:

a planetary gear mechanism that couples the wind turbine to the mechanical energy storage device.

18. The delineator of claim 1, wherein the mechanical energy storage device comprises a spring.

* * * * *